US007644704B2

(12) United States Patent
Kawajiri et al.

(10) Patent No.: US 7,644,704 B2
(45) Date of Patent: Jan. 12, 2010

(54) FUEL SUPPLY SYSTEM

(75) Inventors: Chiaki Kawajiri, Anjo (JP); Katsuhisa Yamada, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 12/251,283

(22) Filed: Oct. 14, 2008

(65) Prior Publication Data

US 2009/0095264 A1 Apr. 16, 2009

(30) Foreign Application Priority Data

Oct. 12, 2007 (JP) ..... 2007-266852

(51) Int. Cl.
*F02M 37/04* (2006.01)

(52) U.S. Cl. ..... 123/509; 123/510

(58) Field of Classification Search ..... 123/509, 123/510, 511, 467
See application file for complete search history.

(56) References Cited

U.S. PATENT DOCUMENTS 4,592,836 A * 6/1986 Chiao ..... 210/243
5,089,132 A 2/1992 Sussich et al.
5,234,589 A 8/1993 Sussich et al.
6,073,614 A * 6/2000 Kleppner ..... 123/509
6,106,244 A 8/2000 Nakatsukasa et al.
6,142,126 A * 11/2000 Kanamaru ..... 123/509
6,156,201 A * 12/2000 Ueda et al. ..... 210/416.4
6,196,200 B1 * 3/2001 Roche ..... 123/509
6,260,542 B1 * 7/2001 Kochsmeier et al. ..... 123/509
6,267,103 B1 * 7/2001 Ludwig et al. ..... 123/509
6,378,504 B1 * 4/2002 Horiuchi et al. ..... 123/509
6,382,190 B1 * 5/2002 Tanabe et al. ..... 123/509
6,789,529 B2 9/2004 Suzuki et al.
7,306,715 B2 12/2007 Kato et al.

FOREIGN PATENT DOCUMENTS

JP U-H04-039496 4/1992
JP 8-261083 10/1996
JP 8-261099 10/1996

OTHER PUBLICATIONS

Japanese Office Action dated Sep. 1, 2009, issued in counterpart Japanese Application No. 2007-266852, with English translation.

* cited by examiner

*Primary Examiner*—Thomas N Moulis
(74) *Attorney, Agent, or Firm*—Nixon & Vanderhye, PC

(57) ABSTRACT

A fuel supply system includes a fuel pump, a filter element, a pressure regulating valve, and a filter case. The filter case is configured to cover radially inner and outer surfaces of the filter element. The filter case has a receiving portion. A bottom portion of the receiving portion and an end portion of the filter element defines therebetween an outflow chamber for storing fuel. The outflow chamber includes a partitioning member that partitions the outflow chamber into first and second outflow chamber sections. The second outflow chamber section is communicated with an inlet portion of the pressure regulating valve. The partitioning member has a communication portion that provides communication between the first and second outflow chamber sections.

7 Claims, 6 Drawing Sheets

COMPARISON EXAMPLE

FUEL SUPPLY SYSTEM

CROSS REFERENCE TO RELATED APPLICATION

This application is based on and incorporates herein by reference Japanese Patent Application No. 2007-266852 filed on Oct. 12, 2007.

BACKGROUND OF THE INVENTION

1. Field of the Invention

The present invention relates to a fuel supply system that feeds fuel to an internal combustion engine.

2. Description of Related Art

A fuel supply system includes a fuel pump, a filter element, a pressure regulating valve, and a filter case. The filter element removes a foreign object in fuel discharged or pumped by the fuel pump. The pressure regulating valve adjusts pressure of the fuel that has passed through the filter element. The filter case receives the filter element. The fuel supply system limits noise, such as valve hit noise of the pressure regulating valve caused by pulse of fuel discharged from the fuel pump and is known as a fuel pump module (see JP-A-2003-155963 corresponding to U.S. Pat. No. 6,789,529).

In JP-A-2003-155963, there is provided a pipe in an outflow chamber defined by a bottom portion of the filter case and an end portion of the filter element toward the bottom portion for providing connection between the outflow chamber and an inlet portion of the pressure regulating valve. The pipe has an inlet that is positioned in the outflow chamber apart from an inlet portion of the pressure regulating valve.

Thus, fuel, which is discharged to a position close to the inlet portion of the pressure regulating valve of the filter element, may still has to flow around to the inlet of the pipe that is positioned apart from the inlet portion of the pressure regulating valve. Then, the fuel flows through the pipe to flow into the pressure regulating valve. Due to the above configuration, pulse of fuel that flows out of the filter element is limited, and thereby noise, such as a valve hit noise of the pressure regulating valve, is limited from being generated.

For example, there has been known a small-sized fuel pump module, in which a filter element is configured to cover an outer periphery of the fuel pump and a filter case for receiving the filter element is configured to cover a radially inner wall and a radially outer wall of the filter element (see JP-A-2004-68679 corresponding to U.S. Pat. No. 7,306,715).

However, when a fuel pulse limiting pipe in JP-A-2003-155963 is applied to a filter case in JP-A-2004-68679, the following disadvantages may occur.

The filter element described in JP-A-2003-155963 has a cylindrical column shape. Because the filter case receives the above cylindrical filter element, the outflow chamber formed at the bottom portion of the filter case is also required to have a cylindrical column shape. In contrast, the filter element described in JP-A-2004-68679 has a hollow cylindrical shape. The filter case is configured to cover the radially inner wall and the radially outer wall of the filter element. As a result, the outflow chamber provided at the bottom portion of the filter case has a circular ring shape. As the filter case is further reduced in size, the outflow chamber has a shorter dimension in a radial direction.

As a result, it is considerably difficult to assemble a fuel pulse limiting pipe to the bottom portion of the filter case described in JP-A-2004-68679. Also, in a case, where the small filter case is further reduced in size, it becomes more difficult for an operator to put his or her hand into the bottom portion of the filter case, and thereby the operator is unable to assemble the pipe.

SUMMARY OF THE INVENTION

The present invention is made in view of the above disadvantages. Thus, it is an objective of the present invention to address at least one of the above disadvantages.

To achieve the objective of the present invention, there is provided A fuel supply system includes a fuel pump, a filter element, a pressure regulating valve, and a filter case. The fuel pump pumps fuel in a fuel tank to forcibly feed fuel. The filter element is configured to cover at least part of an outer periphery of the fuel pump. The filter element removes a foreign object in fuel discharged by the fuel pump. The pressure regulating valve is configured to adjust pressure of fuel that has passed through the filter element. The filter case is configured to cover a radially inner surface and a radially outer surface of the filter element. The filter case has a receiving portion that has a bottom portion. The filter element has an end portion on a side of the filter element toward the bottom portion. The bottom portion of the receiving portion and the end portion of the filter element defines therebetween an outflow chamber for storing fuel that has passed through the filter element. The outflow chamber includes a partitioning member that partitions the outflow chamber into a first outflow chamber section and a second outflow chamber section such that the first outflow chamber section is separated from the second outflow chamber section in a longitudinal direction. The first outflow chamber section is provided on a side of the second outflow chamber section toward the filter element. The second outflow chamber section is communicated with an inlet portion of the pressure regulating valve. The partitioning member has a communication portion that provides communication between the first outflow chamber section and the second outflow chamber section.

BRIEF DESCRIPTION OF THE DRAWINGS

The invention, together with additional objectives, features and advantages thereof will be best understood from the following description, the appended claims and the accompanying drawings in which:

DETAILED DESCRIPTION OF PREFERRED EMBODIMENTS

Multiple embodiments of the present invention will be described with accompanying drawings.

First Embodiment

Figure 1:
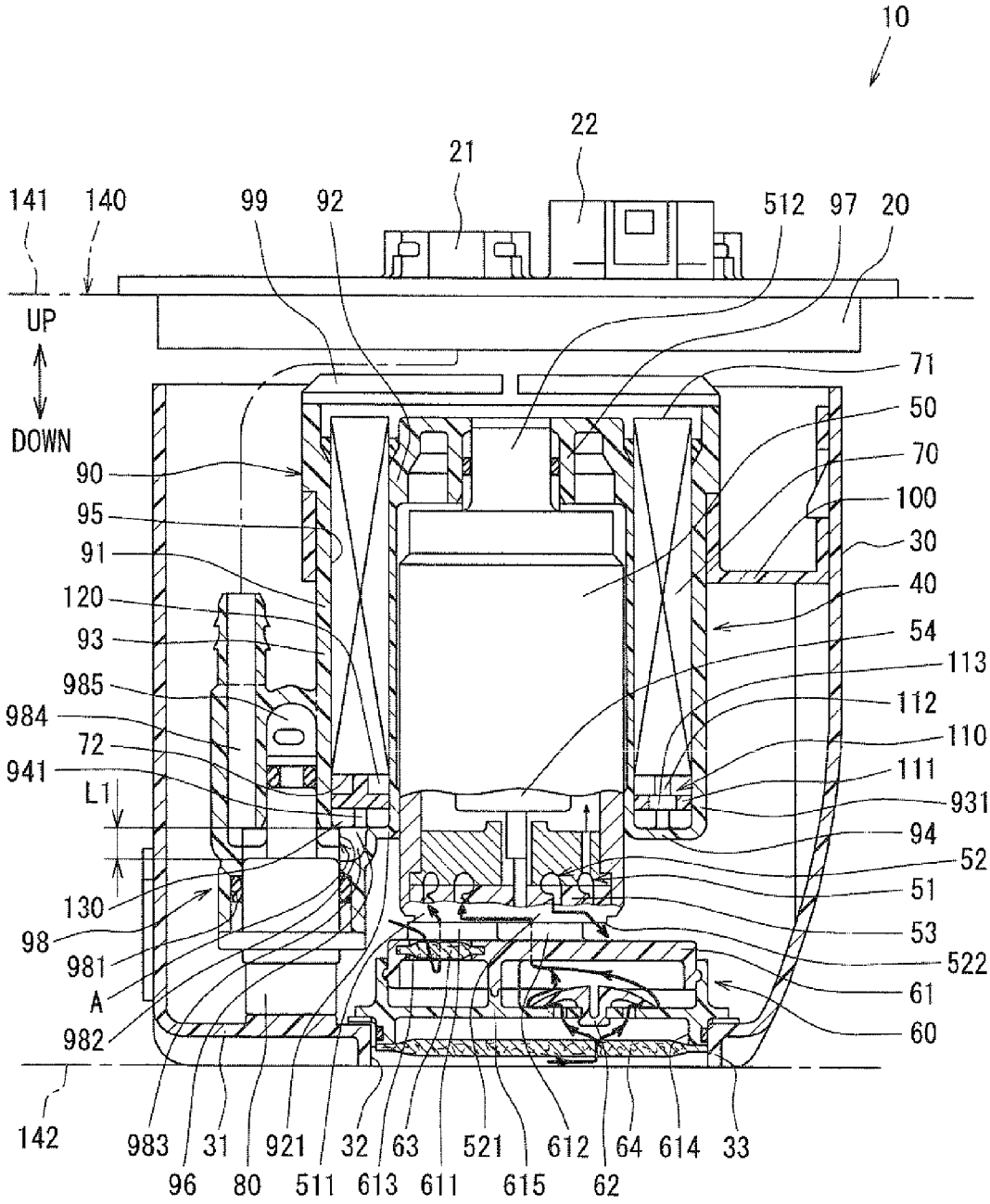
FIG. 1 is a cross-sectional view of a fuel supply system that is provided with a ring member serving as a fuel pulse reducing device according to the first embodiment of the present invention.

A fuel supply system according to the first embodiment of the present invention is shown in FIG. 1. A fuel supply system 10 is an intank fuel supply system that is received in a fuel tank 140 for, for example, a two-wheeled vehicle or a four-wheeled vehicle. FIG. 1 is a cross-sectional view illustrating a receiving state, where the fuel supply system 10 is received in the fuel tank 140 mounted on the vehicle. Up-down axis shown by arrows in FIG. 1 indicates a gravitational force axis of the fuel tank 140 in a state, where the fuel tank 140 is mounted on the vehicle.

The fuel supply system 10 includes a cover member 20, a sub tank 30, and a pump unit 40.

The cover member 20 is made of a resin to have a disk shape and is attached to close an opening formed on an upper wall 141 of the fuel tank 140 that is made of a resin. Note that, the fuel tank 140 may be alternatively made of a metal.

The cover member 20 integrally includes a fuel discharge tube 21 and an electric connector 22, which are made of a resin. The fuel discharge tube 21 feeds the fuel, which is discharged by the pump unit 40 received in the sub tank 30, to an internal combustion engine (not shown) located external of the fuel tank 140. The electric connector 22 is in electrically connected with an electric connector (not shown) of the pump unit 40 via lead wires (not shown) and via a power supply connector (not shown) to supply electric power to the pump unit 40. Also, the cover member 20 has an end surface toward the sub tank 30, and a shaft (not shown) is press fitted into the end surface of the cover member 20 to extend toward the sub tank 30.

The sub tank 30 is made of a resin to have a hollow cylindrical shape with a bottom, and is provided directly below the cover member 20. The sub tank 30 receives the pump unit 40 and stores a part of fuel in the fuel tank 140.

The sub tank 30 has a side wall that has a receiving portion (not shown), and the receiving portion loosely receives a lower end portion of the shaft that is press fitted into the cover member 20. There is provided a spring (not shown) between the cover member 20 and the receiving portion of the sub tank 30. The spring biases the cover member 20 and the sub tank 30 such that the cover member 20 and the sub tank 30 are spaced apart from each other.

As a result, even when the resin fuel tank 140 expands and contracts due to a change of internal pressure or a change of fuel amount caused by temperature variation, the biasing force of the spring always presses a bottom portion 31 of the sub tank 30 against a bottom portion 142 of the fuel tank 140.

The bottom portion 31 of the sub tank 30 includes an opening 32. The opening 32 has a leg 33 at an edge portion of the opening 32, which leg 33 projects toward the bottom portion 142 of the fuel tank 140.

The pump unit 40 includes a fuel pump 50, a filter assembly 60, a filter element 70, a pressure regulating valve 80, and a filter case 90. The filter case 90 receives all of the above components of the pump unit 40 except the filter assembly 60.

The fuel pump 50 includes a feed pump member 51, a lift pump member 52, and an electric motor unit 54. The feed pump member 51 suctions fuel inside the sub tank 30 to feed the fuel to the internal combustion engine. The lift pump member 52 pumps up fuel outside the sub tank 30 into the sub tank 30. The electric motor unit 54 drives the above pump members 51, 52.

Each of the feed pump member 51 and the lift pump member 52 has an arcuate flow path and vanes. The vanes are receive by the respective flow path and are movable in the flow path. Each of the vanes is formed on an impeller 53 that is rotated by the electric motor unit 54. When the impeller 53 is rotated, fuel is suctioned into the respective flow path, and thereby the fuel is increased in pressure in the respective flow path.

The fuel pump 50 has a lower end portion that is provided with a feed pump suction port 511 and with a lift pump suction port 521. The feed pump suction port 511 is in fluid communication with the flow path of the feed pump member 51, and the lift pump suction port 521 is in fluid communication with the flow path of the lift pump member 52. Also, the above lower end portion is provided with a lift pump discharge port 522 that is in fluid communication with the flow path of the lift pump member 52 independently of the suction ports 511, 521. The fuel pump 50 has an upper end portion that is provided with a feed pump discharge port 512 that is configured to discharge the fuel pressurized by the feed pump member 51. The feed pump discharge port 512 corresponds to a discharge port of a fuel pump.

The fuel pump 50 is provided with the filter assembly 60 at the lower end portion of the fuel pump 50 for removing foreign objects in fuel that flows into the pump suction ports 511, 521. The filter assembly 60 includes a case 61, a feed fuel filter 63, and a lift fuel filter 64.

The case 61 has a substantially hollow cylindrical shape. The case 61 has an upper end portion that is provided with a feed fuel outlet port 611, a lift fuel outlet port 612, and a feed fuel inlet port 613. The feed fuel outlet port 611 is connected with the feed pump suction port 511, and the lift fuel outlet port 612 is connected with the lift pump suction port 521. The feed fuel inlet port 613 allows fuel in the sub tank 30 to flow into the case 61. The feed fuel inlet port 613 is attached with the feed fuel filter 63 by welding or insert molding.

The case 61 has a lower end portion that is provided with a lift fuel inlet port 614. The lift fuel inlet port 614 is fitted with the opening 32 of the sub tank 30. The lift fuel inlet port 614 is attached with the lift fuel filter 64 by welding or the insert molding.

There is provided a section member 615 in the case 61 such that the section member 615 defines a first route and a second route. The first route conveys fuel in the sub tank 30 to the feed fuel outlet port 611 from the feed fuel inlet port 613, and the second route conveys fuel outside the sub tank 30 to the lift fuel outlet port 612 from the lift fuel inlet port 614. There is provided a check valve 62 in the second route, and thereby the fuel once pumped up into the sub tank 30 is limited from flowing backward out of the sub tank 30.

By operating the electric motor unit 54 to rotate the impeller 53, the feed pump member 51 and the lift pump member 52 are made to generate suction forces. The feed pump member 51 suctions fuel inside the sub tank 30 through the first route. The lift pump member 52 suctions fuel outside the sub tank 30 through the second route.

The fuel suctioned through the feed pump suction port 511 is discharged through the feed pump discharge port 512 to be supplied to the filter element 70. The fuel suctioned through the lift pump suction port 521 is discharged through the lift pump discharge port 522 to be supplied into the sub tank 30.

The filter element 70 has a hollow cylindrical shape such that the filter element 70 covers the radially outer periphery of the fuel pump 50. Also, the filter element 70 is received by the filter case 90. The filter case 90 is fixed to the sub tank 30 by a support member 100. The filter case 90 has a case main body 91 and a cap portion 99 to have a hollow cylindrical shape.

The case main body 91 has an inner tubular portion 92, an outer tubular portion 93, a bottom portion 94, a fuel inflow portion 97, and a fuel outflow portion 98. The case main body 91 is integrally made of a resin as a one-piece structure. The inner tubular portion 92 covers the radially outer periphery of the fuel pump 50. The outer tubular portion 93 has a diameter greater than a diameter of the inner tubular portion 92, and is provided on a radially outer peripheral side of the inner tubular portion 92 to cover the inner tubular portion 92.

The inner tubular portion 92 has an upper end portion that is molded of a resin integrally with the fuel inflow portion 97. The fuel inflow portion 97 is connected with the feed pump discharge port 512 of the fuel pump 50 and allows fuel to flow into the filter case 90. The fuel inflow portion 97 has a hollow cylindrical shape. A gap between the fuel inflow portion 97 and the feed pump discharge port 512 is sealed by an O-ring.

The bottom portion 94 is provided below the inner tubular portion 92 and the outer tubular portion 93 and is connected with lower end portions 921, 931 of the tubular portions 92, 93 respectively. The bottom portion 94 is provided with a rib 941 that projects upwardly from the bottom portion 94. In other words, the rib 941 projects from the bottom portion 94 toward the filter element 70 along an longitudinal axis of the filter case 90. The inner tubular portion 92, the outer tubular portion 93, and the bottom portion 94 define a receiving portion 95 that receives the filter element 70. The inner tubular portion 92 covers a radially inner surface of the filter element 70, and the outer tubular portion 93 covers a radially outer surface of the filter element 70.

The cap portion 99 is provided on the upper side of the case main body 91 to cover a gap between the inner tubular portion 92 and the outer tubular portion 93. Due to the above structure, the upper side of the case main body 91 is tightly sealed. The fuel, which flows into the filter case 90 through the fuel inflow portion 97, flows into the filter element 70 from an upper end portion 71 of the filter element 70.

Figure 2:
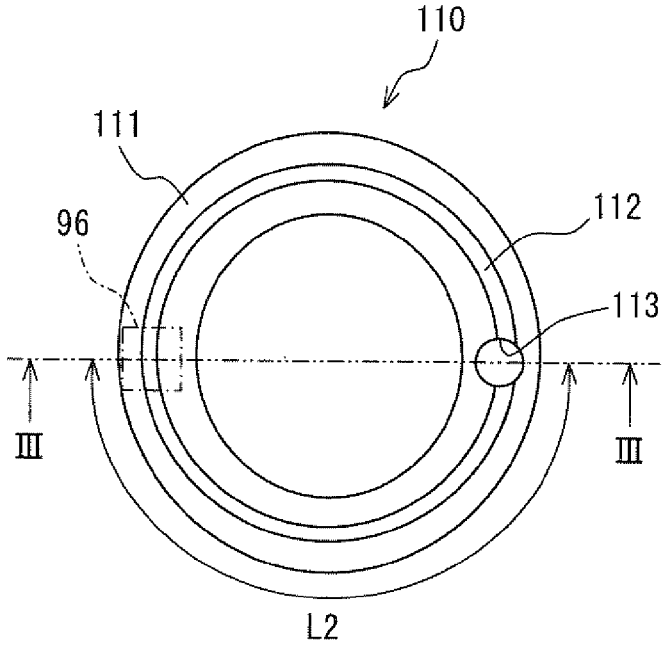
FIG. 2 is a plan view of the ring member.
Figure 3:
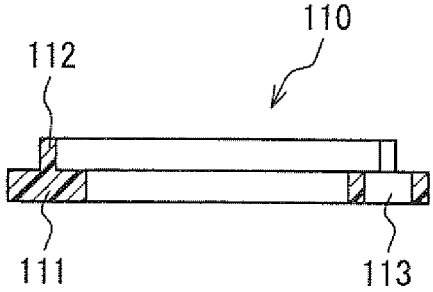
FIG. 3 is a cross-sectional view taken along line III-III in FIG. 2.

A lower end portion 72 of the filter element 70 and the bottom portion 94 define a space therebetween, and a ring member 110 is provided in the above space. As shown in FIG. 2 and FIG. 3, the ring member 110 includes a ring portion 111 and a projection portion 112. The lower end portion 72 corresponds to an end portion of a filter element toward a bottom portion. The ring member 110 serves as a fuel pulse reducing device.

The ring portion 111 is made of a resin to have a circular ring shape. The ring portion 111 has a rectangular cross section, which is taken along a plane perpendicular to a radial direction. The ring portion 111 has a radial dimension, which is generally identical with a distance measured between the inner tubular portion 92 and the outer tubular portion 93. The ring portion 111 is provided above the rib 941.

The ring portion 111 has an upper end portion that is provided with the projection portion 112, and the projection portion 112 projects from the upper end portion toward the lower end portion 72 of the filter element 70. The projection portion 112 has a radial dimension that is narrower than the radial dimension of the ring portion 111. The ring portion 111 and the projection portion 112 are integrally made of a resin as a one-piece structure. The projection portion 112 corresponds to a first projection. The projection portion 112 extend in a circumferential direction to have an arcuate shape as shown in FIG. 2, for example.

The ring member 110 is provided in the space defined by the lower end portion 72 of the filter element 70 and the bottom portion 94 such that two outflow chambers (a first outflow chamber section 120 and a second outflow chamber section 130) are defined. The outflow chambers 120, 130 are separate from each other along the longitudinal axis of the filter case 90. The first outflow chamber section 120 is positioned on a side of the ring member 110 toward the lower end portion 72 of the filter element 70. The second outflow chamber section 130 is positioned on the other side of the ring member 110 toward the bottom portion 94. The ring member 110 corresponds to a partitioning member.

The first outflow chamber section 120 stores or pools fuel that flows out of the lower end portion 72 of the filter element 70. As shown in FIGS. 1 to 3, the ring portion 111 is provided with a communication hole 113 that provides communication between the first outflow chamber section 120 and the second outflow chamber section 130. Due to the above structure, fuel stored in the first outflow chamber section 120 flows into the second outflow chamber section 130 via the communication hole 113. The communication hole 113 corresponds to a communication portion.

The lower end portion 931 of the outer tubular portion 93 is molded of a resin integrally with the fuel outflow portion 98. The fuel outflow portion 98 includes a receiving portion 981, a fuel passage 983, an outflow passage 984, and a discharge passage 985. The receiving portion 981 receives the pressure regulating valve 80 that adjusts pressure of fuel, which has passed through the filter element 70.

The fuel passage 983 connects an outlet opening 96 with an inlet opening 982. The outlet opening 96 is provided to the bottom portion 94 to be communicated with the second outflow chamber section 130, and the inlet opening 982 is provided to the receiving portion 981 to be communicated with an inlet side of the pressure regulating valve 80. The inlet opening 982 corresponds to an inlet portion of a pressure regulating valve.

It should be noted that the inlet opening 982 has a passage cross-sectional area A that is greater than a passage cross-sectional area of each of the first outflow chamber section 120, the second outflow chamber section 130, the communication hole 113, and the feed pump discharge port 512 of the fuel pump 50. Also, the passage cross-sectional area of each of the first outflow chamber section 120, the second outflow chamber section 130, and the communication hole 113 is greater than the passage cross-sectional area of the feed pump discharge port 512. As a result, pressure drop of fuel measured between the feed pump discharge port 512 and the inlet opening 982 is limited from increasing.

The outflow passage 984 is connected with the receiving portion 981 to allow the fuel, pressure of which is adjusted by the pressure regulating valve 80, to outflow. The fuel flowing out of the outflow passage 984 is discharged through the fuel discharge tube 21 via a piping shown by a dashed and single-dotted line . The discharge passage 985 is connected with the receiving portion 981 to discharge the excessive fuel into the sub tank 30. In the above, the excessive fuel corresponds to fuel associated with the excessive pressure, which is made during the pressure adjustment by the pressure regulating valve 80.

Next, a pulse reduction effect of the ring member 110 for reducing pulse (pulsation) of fuel that is discharged from the fuel pump 50 will be described with reference to FIGS. 1 to 5.

The fuel discharged from the feed pump discharge port 512 pulses due to the rotation of the electric motor unit 54 of the fuel pump 50. The pulse of fuel is further amplified or enhanced when the fuel passes through the filter element 70. When the above fuel having the amplified pulse flows into the pressure regulating valve 80, a valve element of the pressure regulating valve 80 vibrates severely, and thereby a lift of the valve element becomes unstable. As a result, noise may be generated in the conventional structure.

In general, pulse of fuel is more reduced as a distance between (a) the outlet opening 96 formed on the filter case 90 and (b) the inlet opening 982 of the pressure regulating valve 80 is longer. Thus, when the above distance is shorter in contrast, the valve element of the pressure regulating valve 80 is more influenced by the pulse of fuel, and thereby the valve element vibrates more severely.

Figure 5:
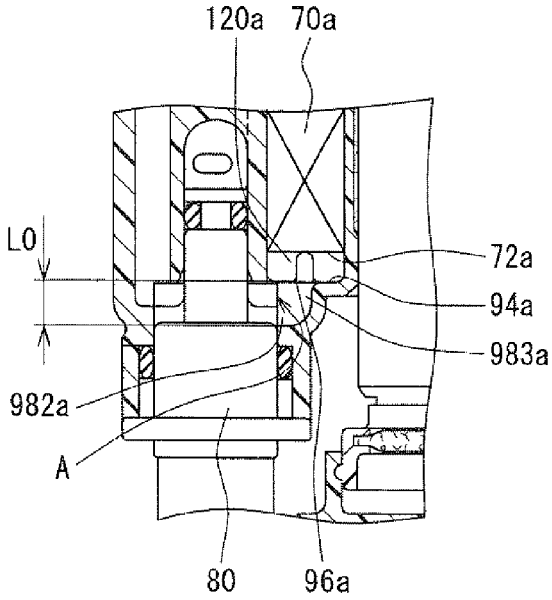
FIG. 5 is an enlarged cross-sectional view of a part of a filter case according to a comparison example.

FIG. 5 is a cross-sectional view of a part of a filter case 90*a* that does not have the ring member 110. The filter case 90*a* shown in FIG. 5 serves as a comparison example.

In the filter case 90*a* shown in FIG. 5, an outflow chamber 120*a* formed between (a) a lower end portion 72*a* of a filter element 70*a* and (b) a bottom portion 94*a* is not provided with the ring member 110 of the present embodiment. The fuel, which has flown into the filter element 70*a*, flows into the outflow chamber 120*a* through an entire surface of the lower end portion 72*a*. The fuel, which flows into the outflow chamber 120*a*, flows out through an outlet opening 96*a*, and flows through a fuel passage 983*a* into an inlet opening 982*a* of the pressure regulating valve 80*a*.

In general, the fuel, which flows out of an influential part of the lower end portion 72*a* of the filter element 70*a*, is most influential to the pressure regulating valve 80 provided that the influential part is located above the outlet opening 96*a*. Because the influential part of the lower end portion 72*a* is located above or closest to the outlet opening 96*a*, a flow passage of the fuel flowing from the influential part to the outlet opening 96*a* is shortest compared with the other part of the lower end portion 72*a* other than the influential part. In a case, where a distance L measured between (a) the influential part, through which the above fuel most influential to the pressure regulating valve 80 flows, and (b) the inlet opening 982 of the pressure regulating valve 80*a* is shorter, the pulse is less suppressed, and thereby the valve element more severely vibrates. In the comparison example shown in FIG. 5, the above distance L corresponds to a distance L0 measured between (a) the outlet opening 96*a* and (b) the inlet opening 982 of the pressure regulating valve 80*a*. A dimension of the fuel passage 983*a* corresponds to the distance L.

It should be noted that in the comparison example of FIG. 5, the distance L0 is 2.78 mm. The passage cross-sectional area A of the inlet opening 982 of the pressure regulating valve 80 is 31.39 $mm^2$. A ratio L/A of the distance L0 to the passage cross-sectional area A is 0.089.

Figure 4:
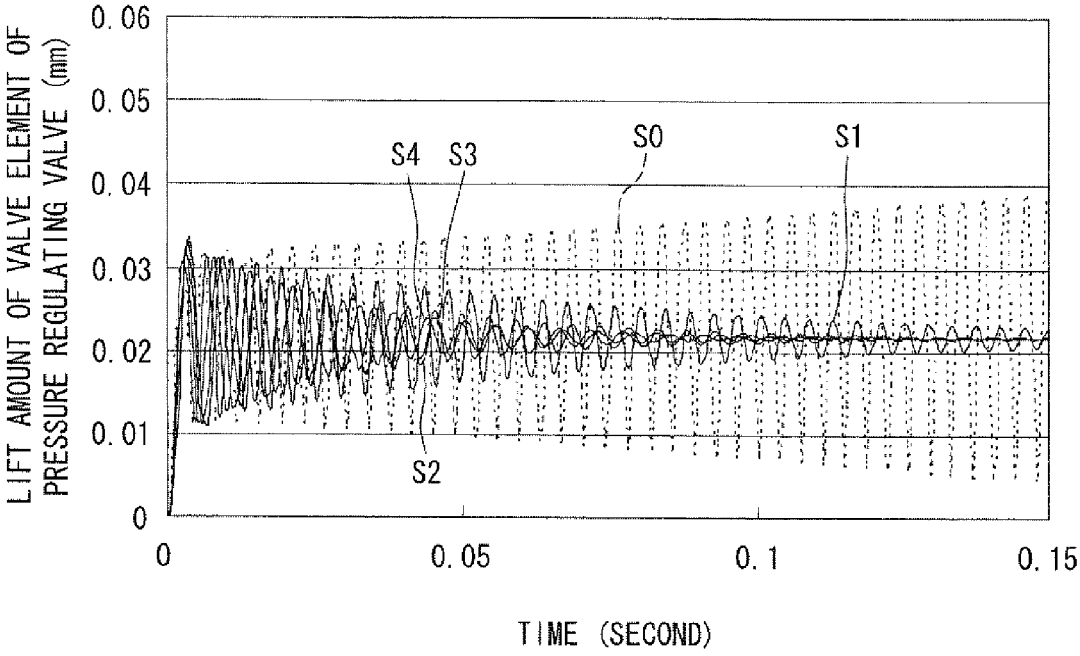
FIG. 4 is a chart showing a lift state of a valve element of the pressure regulating valve when a value of L/A is changed.

FIG. 4 is a chart showing a lift state of the valve element of the pressure regulating valve 80 as a function of time under several conditions, where the ratio L/A of the distance L to the passage cross-sectional area A is set to be certain values. The ordinate axis indicates a lift (in unit of mm) of the valve element of the pressure regulating valve 80, and the abscissa axis indicates an interval time (in unit of second) after the valve element has been lifted. Other conditions are as follows. The passage cross-sectional area A is fixed to be the predetermined value of 31.39 $mm^2$. The passage cross-sectional area A is set at a value such that the pressure drop is limited from being caused when the fuel pump 50 is operated by a normal discharge amount.

A dashed line S0 in FIG. 4 indicates a lift state of the valve element of the pressure regulating valve 80 of the comparison example (L/A=0.089) shown in FIG. 5. As shown in FIG. 4, in the comparison example, the lift of the valve element is not stabilized even when 0.15 seconds elapse after the valve element is lifted.

In contrast, in the present embodiment, the ring member 110 is provided in the space defined between the lower end portion 72 of the filter element 70 and the bottom portion 94 of the filter case 90 for separating the first outflow chamber section 120 from the second outflow chamber section 130 such that the outflow chambers 120, 130 are arranged in the longitudinal direction. The ring member 110 is provided with the communication hole 113 that provides communication between the first outflow chamber section 120 and the second outflow chamber section 130. The communication hole 113 may be provided at another position as required. The communication hole 113 shown in FIGS. 1 to 3 is provided at a position that is furthest from the outlet opening 96 of the filter case 90.

The fuel flowing through the lower end portion 72 of the filter element 70 is temporarily stored in the first outflow chamber section 120. Fuel, which flows into the first outflow chamber section 120 even through a closest portion of the lower end portion 72 closest to the outlet opening 96, does not directly flows into the outlet opening 96. However, the above inflow fuel is temporarily stored in the first outflow chamber section 120 because the ring portion 111 of the ring member 110 is provided between the first outflow chamber section 120 and the outlet opening 96.

The fuel stored in the first outflow chamber section 120 is pushed by the fuel, which is newly flowing through the lower end portion 72 of the filter element 70, and flows into the second outflow chamber section 130 via the communication hole 113. The fuel, which flows into the second outflow chamber section 130, flows through the outlet opening 96 that is provided on the bottom portion 94, and flows into the inlet opening 982 of the pressure regulating valve 80 through the fuel passage 983. As shown in FIG. 2, a distance L2 corresponds to a dimension of a flow passage in the second outflow chamber section 130 measured between the communication hole 113 to the outlet opening 96.

In a case, where the ring member 110 is provided between the lower end portion 72 of the filter element 70 and the bottom portion 94 as above, the influential part, from which the fuel most influential to the pressure regulating valve 80 flows, does not correspond to the outlet opening 96, but to the communication hole 113. As a result, in FIG. 1 and FIG. 2, the distance L, which is measured between the influential part and the inlet opening 982 of the pressure regulating valve 80, corresponds to a total dimension of the distance L1 and the distance L2. In other words, the distance L corresponds to a dimension of the shortest fuel passage measured between the communication hole 113 and the inlet opening 982 of the pressure regulating valve 80. In the above, the distance L1 is measured between the outlet opening 96 of the filter case 90 and the inlet opening 982 of the pressure regulating valve 80, and the distance L2 is measured between the communication hole 113 and the outlet opening 96 in the second outflow chamber section 130.

The above total distance L is longer than the distance L0. Because the distance L is able to be made longer, the pulse of the fuel that flows out of the filter element 70 is further reduced.

The outflow chamber is provided with the partitioning member 110 that partitions the outflow chamber into the first outflow chamber section 120 and the second outflow chamber section 130, which are arranged in the longitudinal direction. Thus, fuel, which flows out of the filter element 70 into the first outflow chamber section 120, is caused to flow into the inlet portion 982 of the pressure regulating valve 80 via the communication portion 113 and the second outflow chamber section 130. As a result, a distance of a flow passage of the fuel, through which passage the fuel flows out of the filter element 70 into the inlet portion 982 of the pressure regulating valve 80, is able to be made longer. Thus, pulse of fuel is more effectively reduced, and thereby the noise generated by the pressure regulating valve 80 is reduced, The partitioning member 110 is assembled just by inserting the partitioning member 110 into the bottom portion 94 of the filter case 90 even if the receiving portion 95 has a narrow dimension. Therefore, compared with the pipe of the conventional technique, the partitioning member 110 is more easily assembled.

Four solid lines S1, S2, S3, S4 in FIG. 4 indicate the lift amount of the valve element when L/A is set at 0.2, 0.4, 0.6, and 0.8, respectively. The passage cross-sectional area A is 31.39 $mm^2$ similar to the passage cross-sectional area A of the comparison example.

The solid line S1 indicates the lift state of the valve element when L/A is set at 0.2, or in other words, when L is set at 6.32 mm. As shown in FIG. 4, the amplitude of the lift of the above case indicated by the solid line S1 is smaller than the amplitude of the lift of the comparison example indicated by the dashed line S0 although a fluctuation of the lift amount of the valve element of the above case does not converge to be substantially small even after at least 0.15 seconds have elapsed.

The solid line S2 indicates the lift state of the valve element when L/A is set at 0.4, or in other words, when L is set at 12.65 mm. The solid line S3 indicates the lift state of the valve element when L/A is set at 0.6, or in other words, when L is set at 18.96 mm. The solid line S4 indicates the lift state of the valve element when L/A is set at 0.8, or in other words, when L is set at 25.28 mm. The lift of the valve element becomes stabilized at a lift amount of 0.22 mm when 0.1 seconds have elapsed under the above cases indicated by the solid lines S2 to S4.

In the above analysis, the lift of the valve element is stabilized when L/A is set equal to or greater than 0.2, and thereby noise of the pressure regulating valve 80 is limited from being generated.

In the configuration of the present embodiment, the bottom portion 94 of the receiving portion 95, the distance L corresponds to a shortest dimension measured between the communication portion 113 and the inlet portion 982. More specifically, the distance L has the distance L1 and the distance L2. The distance L2 is a dimension of an arcuate flow passage in the second outflow chamber section 130 measured between the communication portion 113 and the outlet opening 96, for example. The distance L1 is a dimension measured between the outlet opening 96 and the inlet portion 982 of the pressure regulating valve 80. Also, the inlet portion 982 has the passage cross-sectional area A. By locating the communication portion 113 at a position such that the relation of L/A is equal to or greater than 0.2, pulse of fuel discharged from the fuel pump 50 is reduced.

In the above distance L, the distance L1 is not made longer because a longitudinal dimension of the filter case 90 is not made longer. In contrast, the distance L2 is easily made longer by rotating the ring member 110 in a circumferential direction. Due to the above, without changing the longitudinal direction of the filter case 90, the distance L is made longer. Also, because another member is not required for different distances L, the manufacturing cost is limited from increasing.

In the filter case 90 of the present embodiment, or in other words, in the filter case 90, in which the receiving portion 95 for receiving the filter element 70 is provided between the inner tubular portion 92 and the outer tubular portion 93, the outflow chamber provided at the lower end portion 72 of the filter element 70 is accordingly configured to have a circular ring shape.

Also, in a case, where the filter case 90 is reduced in size, the distance measured between the inner tubular portion 92 and the outer tubular portion 93 may become smaller. In the present embodiment, even in the above case, assembly is easily made just by inserting the ring member 110 having a simple structure into the case main body 91 from the upper side or the opening of the case main body 91.

In the above configuration in the present embodiment, because the filter element 70 is supported by the first projection 112 of the partitioning member 110, the first outflow chamber section 120 is defined between the end portion 72 of the filter element 70 and the partitioning member 110. Also, because the partitioning member 110 is supported by the rib 941 formed on the bottom portion 94, the second outflow chamber section 130 is defined between the partitioning member 110 and the bottom portion 94. As a result, by a simple structure, the first outflow chamber section 120 and the second outflow chamber section 130 are arranged in the longitudinal direction.

Second Embodiment

Figure 6:
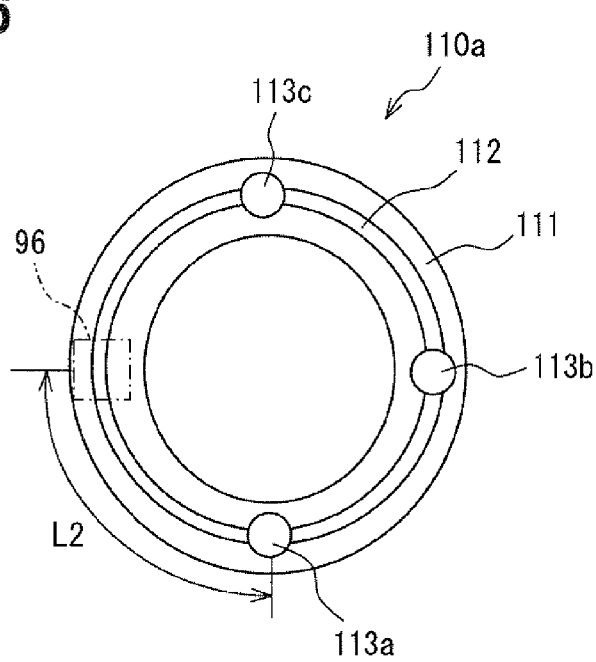
FIG. 6 is a plan view of a ring member according to the second embodiment of the present invention.

FIG. 6 shows the second embodiment of the present invention. Similar components of a fuel supply system of the present embodiment, which are similar to the components of the fuel supply system of the first embodiment, will be indicated by the same numerals, and explanation thereof will be omitted.

In the second embodiment shown in FIG. 6, a ring member 110*a* is provided with multiple communication holes. In the present embodiment, three communication holes 113*a* to 113*c* are provided, for example. Due to the above configuration, flow of the fuel from the first outflow chamber section 120 to the second outflow chamber section 130 is effectively secured. In the above case, in the distance L, the distance L2 is measured between the communication hole 113*a* and the outlet opening 96. The distance L2 is a shortest one of the distances measured between (a) the outlet opening 96 and (b) each of the communication holes 113*a* to 113*c*.

Third Embodiment

The third embodiment of the present invention will be described with reference to FIG. 7 and FIG. 8. Similar components of a fuel supply system of the present embodiment, which are similar to the components of the fuel supply system of the first embodiment, will be indicated by the same numerals, and explanation thereof will be omitted.

Figure 7:
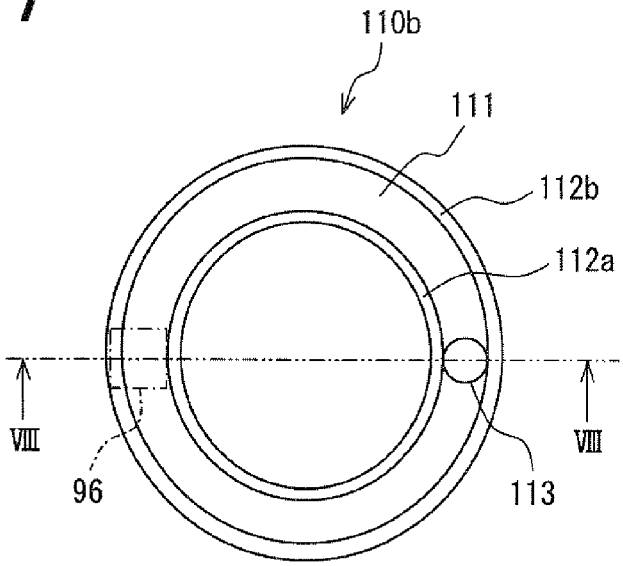
FIG. 7 is a plan view of a ring member according to the third embodiment of the present invention.
Figure 8:
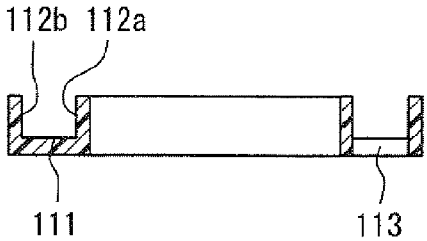
FIG. 8 is a cross-sectional view taken along line VIII-VIII in FIG. 7.

In the third embodiment shown in FIG. 7 and FIG. 8, a ring member 110*b* includes projection portions 112*a*, 112*b*, which project upward from a radially inner edge and a radially outer edge of the ring portion 111, respectively. The projection portions 112*a*, 112*b* have circular ring shapes. The projection portions 112*a*, 112*b* support the lower end portion 72 of the filter element 70 when the ring member 110*b* is received in the filter case 90. Also, in the present embodiment, the ring portion 111 may alternatively be also provided with multiple communication holes 113.

Fourth Embodiment

The fourth embodiment of the present invention will be described with reference to FIG. 9 and FIG. 10. Similar components of a fuel supply system of the present embodiment, which are similar to the components of the fuel supply system of the first and third embodiments, will be indicated by the same numerals, and explanation thereof will be omitted.

Figure 9:
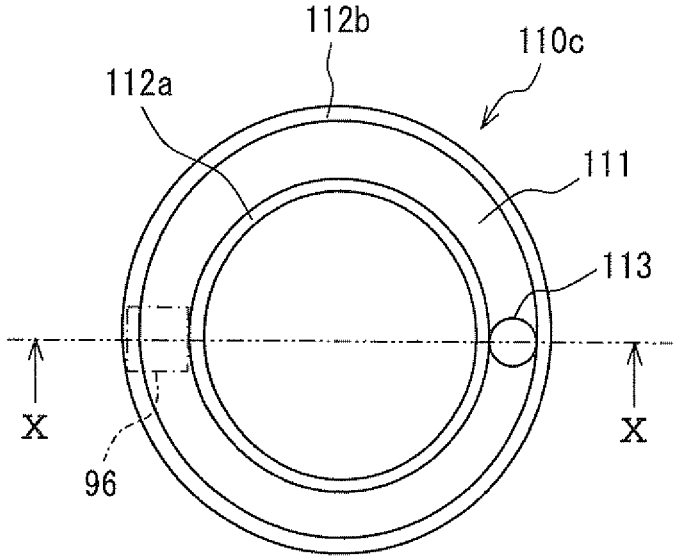
FIG. 9 is a plan view of a ring member according to the fourth embodiment of the present invention.
Figure 10:
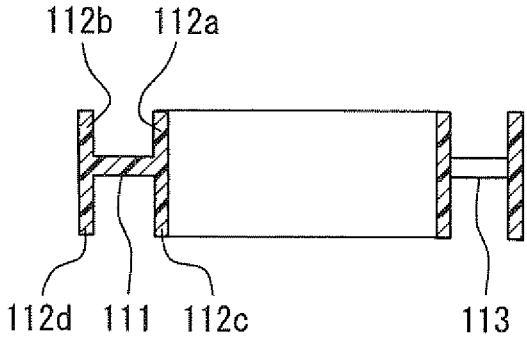
FIG. 10 is a cross-sectional view taken along line X-X in FIG. 9.

In the fourth embodiment shown in FIG. 9 and FIG. 10, the ring member 110*c* has projection portions 112*a* to 112*d* that extend from the radially inner edge and the radially outer edge of the ring portion 111 upwardly and downwardly. In other words, the projection portions 112*a* to 112*d* project from the radially inner and outer edges of the ring portion 111 in both directions along the axis perpendicular to a plane, on which the ring member 111 extends, for example, The projection portions 112*a* to 112*d* have circular ring shapes. When the ring member 110*c* is received in the filter case 90, the projection portions 112*a*, 112*b* support the lower end portion 72 of the filter element 70, and the projection portions 112*c*, 112*d* are supported by the bottom portion 94 of the filter case 90. Due to the above configuration, even in a configuration, where the bottom portion 94 of the filter case 90 is not provided with the rib 941, the first outflow chamber section 120 and the second outflow chamber section 130 are able to be defined. Also, in the present embodiment, the ring portion 111 may be alternatively provided with multiple communication holes 113.

Fifth Embodiment

The fifth embodiment of the present invention will be described with reference to FIG. 11 and FIG. 12. Similar components of a fuel supply system of the present embodiment, which are similar to the components of the fuel supply system of the first embodiment, will be indicated by the same numerals, and explanation thereof will be omitted.

Figure 11:
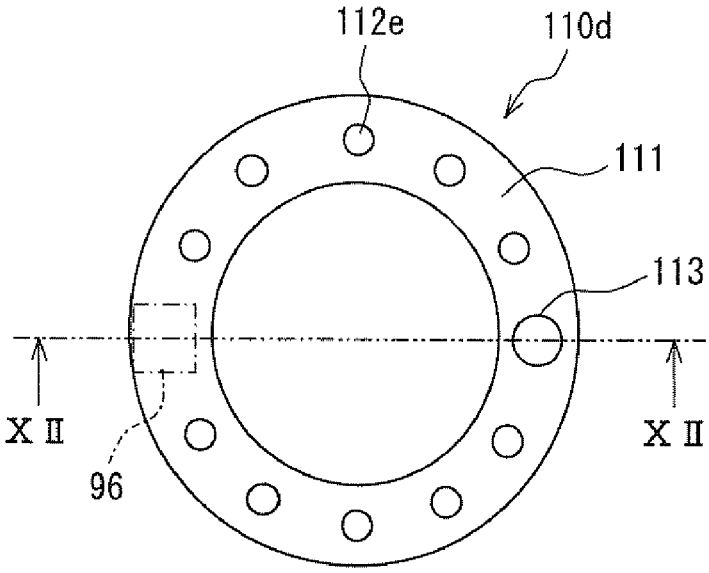
FIG. 11 is a plan view of a ring member according to the fifth embodiment of the present invention.
Figure 12:
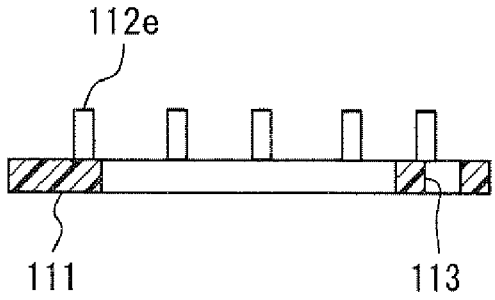
FIG. 12 is a cross-sectional view taken along line XII-XII in FIG. 11.

In the fifth embodiment shown in FIG. 11 and FIG. 12, the ring member 110*d* has multiple cylindrical projection portions 112*e* that extend upwardly from one side of the ring portion 111. More specifically, the cylindrical projection portions 112*e* are arranged along a center line that is defined in the middle of the radial inner and outer edges of the ring portion 111, and the projection portions 112*e* extend along the axis perpendicular to the plane, on which the ring portion 111 extend. When the ring member 110*d* is received in the filter case 90, each of the projection portions 112*e* supports the lower end portion 72 of the filter element 70. Also, in the present embodiment, the ring portion 111 may be alternatively provided with multiple communication holes 113. Also, the ring portion 111 may be provided with multiple projections on the other side or the lower surface of the ring portion 111, and the multiple projections extend downwardly.

Additional advantages and modifications will readily occur to those skilled in the art. The invention in its broader terms is therefore not limited to the specific details, representative apparatus, and illustrative examples shown and described.

What is claimed is:

1. A fuel supply system comprising:

a fuel pump that pumps fuel in a fuel tank to forcibly feed fuel;

a filter element that is configured to cover at least part of an outer periphery of the fuel pump, wherein the filter element removes a foreign object in fuel discharged by the fuel pump;

a pressure regulating valve that is configured to adjust pressure of fuel that has passed through the filter element; and a filter case that is configured to cover a radially inner surface and a radially outer surface of the filter element, wherein:

the filter case has a receiving portion that has a bottom portion;

the filter element has an end portion on a side of the filter element toward the bottom portion;

the bottom portion of the receiving portion and the end portion of the filter element defines therebetween an outflow chamber for storing fuel that has passed through the filter element;

the outflow chamber includes a partitioning member that partitions the outflow chamber into a first outflow chamber section and a second outflow chamber section such that the first outflow chamber section is separated from the second outflow chamber section in a longitudinal direction;

the first outflow chamber section is provided on a side of the second outflow chamber section toward the filter element;

the second outflow chamber section is communicated with an inlet portion of the pressure regulating valve; and the partitioning member has a communication portion that provides communication between the first outflow chamber section and the second outflow chamber section.

2. The fuel supply system according to claim 1, wherein:

a distance of L corresponds to a dimension of a shortest flow passage measured between the communication portion of the partitioning member and the inlet portion of the pressure regulating valve;

the inlet portion has a passage cross-sectional area of A; and the communication portion is located such that a relation of $L/A \geqq 0.2$ is satisfied.

3. The fuel supply system according to claim 1, wherein:

the inlet portion of the pressure regulating valve has a passage cross-sectional area that is greater than a passage cross-sectional area of each of a discharge port of the fuel pump, the first outflow chamber section, the second outflow chamber section, and the communication portion; and the passage cross-sectional area of each of the first outflow chamber section, the second outflow chamber section, and the communication portion is greater than the passage cross-sectional area of the discharge port of the fuel pump.

4. The fuel supply system according to claim 1, wherein:

the communication portion is one of a plurality of communication portions that are provided to the partitioning member.

5. The fuel supply system according to claim 1, wherein:

the partitioning member has a first projection on an end surface of the partitioning member toward the first outflow chamber section;

the first projection supports the end portion of the filter element; and the filter case has a rib on the bottom portion of the filter case for supporting the partitioning member.

6. The fuel supply system according to claim 1, wherein:

the partitioning member has a first projection on an end surface of the partitioning member toward the first outflow chamber section;

the first projection supports the end portion of the filter element;

the partitioning member has a second projection on another end surface of the partitioning member toward the second outflow chamber section; and the second projection projects toward the bottom portion of the filter case.

7. The fuel supply system according to claim 2, wherein:

the passage cross-sectional area of the inlet portion is greater than a passage cross-sectional area of each of a discharge port of the fuel pump, the first outflow chamber section, the second outflow chamber section, and the communication portion; and the passage cross-sectional area of each of the first outflow chamber section, the second outflow chamber section, and the communication portion is greater than the passage cross-sectional area of the discharge port of the fuel pump.

* * * * *